United States Patent [19]

Ishikawa

[11] 4,226,584

[45] Oct. 7, 1980

[54] ROTARY COMBUSTOR WALL

[75] Inventor: Tokihiko Ishikawa, Yokohama, Japan

[73] Assignee: O'Connor Engineering Laboratories, Inc., Costa Mesa, Calif.

[21] Appl. No.: 25,982

[22] Filed: Apr. 2, 1979

[51] Int. Cl.[3] ..... F27D 15/00

[52] U.S. Cl. ..... 432/77; 110/246; 432/116; 432/118

[58] Field of Search ..... 110/234, 246; 432/77, 432/116, 118, 233

[56] References Cited

U.S. PATENT DOCUMENTS

| | | | |
|---|---|---|---|
| 3,487,793 | 1/1970 | Lerner et al. | 110/246 |
| 3,822,651 | 7/1974 | Harris et al. | 110/234 |
| 4,066,024 | 1/1978 | O'Connor | 110/236 |

*Primary Examiner*—John J. Camby

*Attorney, Agent, or Firm*—Leydig, Voit, Osann, Mayer & Holt, Ltd.

[57] ABSTRACT

A rotary kiln or combustor having a plurality of water cooled pipes secured together to define a cylinder in which material is burned. The cylinder slowly rotates about its axis, and the pipes are secured together so as to define a plurality of intermediate openings making the cylinder gas porous and through which combustion air is introduced. The improvement comprises providing a plurality of pins, secured directly to the pipes on the inside of the cylinder, that create a pattern of projections to support burning material slightly spaced from the inner cylinder wall.

1 Claim, 2 Drawing Figures

ROTARY COMBUSTOR WALL

This invention relates generally to a rotary kiln or combustor and more particularly concerns an improved water cooled wall for such a device.

The basic kiln or combustor upon which the present invention is an improvement is disclosed and claimed in U.S. Pat. No. 3,822,651, issued July 9, 1974.

Combustion in an incinerator or combustor is greatly dependent upon maintenance of a continuous supply of air, i.e., oxygen, to support the burning reaction, and fast, complete combustion requires not only an adequate supply of air but also good mixing or distribution of the air through the desired combustion region. In the combustor design shown in said United States patent, the cylindrical wall supporting the burning material is gas porous and air is directed through the wall perforations and up and into the burning material.

It has been found that incinerating certain kinds of materials in a combustor of this type results in the material itself acting to alter the desired air flow. If the material to be burned includes nonporous portions that are readily deformable and large enough to span several of the porous wall perforations, air flow can be blocked and incomplete, or at least substantially slowed, combustion will result in the region above and adjacent to the blocked perforations. An example of such difficult-to-handle material is oil sludge transported and fed into the combustor in plastic bags.

It is the primary aim of the invention to prevent air flow blockage in a combustor of the kind discussed above by the use of simple spacer pins.

A collateral object is to provide a novel combustor wall as characterized above which also increases the effective distribution of air under and through the combustion zone.

Another object is to provide a combustor wall improvement of the above type which is economical to manufacture, and which retains the effective water cooled characteristics of the basic wall design.

Figure 1:
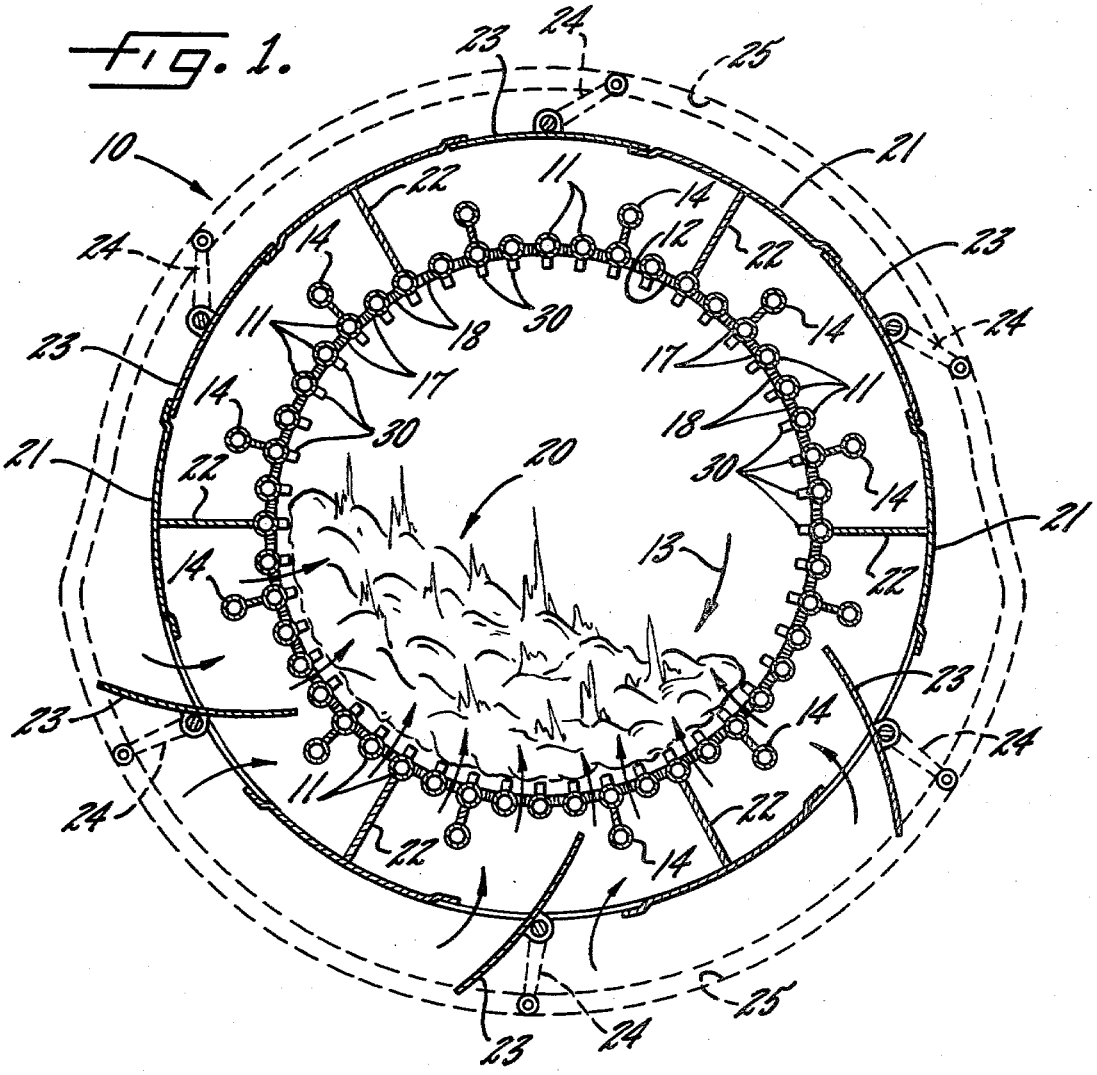
Figure 2:
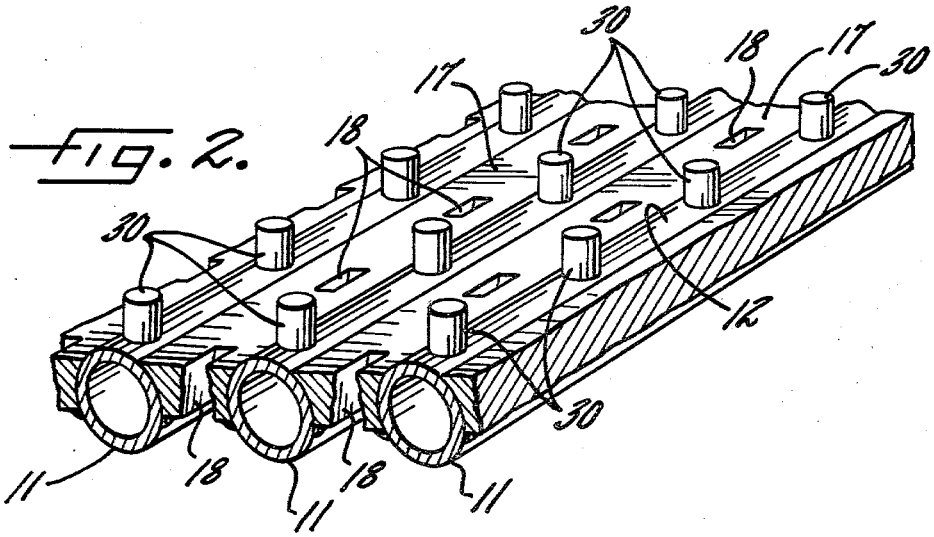

Other objects and advantages of the invention will become apparent upon reading the following detailed description and upon reference to the drawings, in which:

FIG. 1 is a transverse section through a combustor showing a wall embodying the invention; and FIG. 2 is a fragmentary perspective of a portion of the wall shown in FIG. 1.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Turning to the drawing, FIG. 1 shows a section of a rotary kiln or combustor 10 which is formed of a plurality of pipes 11 secured together to define a generally cylindrical inner surface 12. The combustor 10 is mounted, and driven, for slow rotation about its central axis in the direction of the arrow 13. The pipes 11 are water cooled with water being circulated, in the preferred embodiment, in one common direction for all of the pipes 11 and returned in the opposite direction through a group of return pipes 14. A detailed disclosure of what has so far been referred to may be found by reference to said U.S. Pat. No. 3,822,651.

The pipes 11 are joined by perforated strips 17 defining a plurality of openings 18 so that the cylindrical surface 12 is gas porous. Combustion air is supplied to the material 20 being burned through an annular collar 21 mounted on the pipes 11 by walls 22 that section the collar 21 into compartments. The collar sections are selectively opened by pivoted panels 23 controlled by crank arms 24 connected to the panels 23 and whose ends ride in a box cam 25. Again, the operation and structure just referred to is described in greater detail in said United States patent.

In accordance with the invention, a plurality of projections, preferably in the form of short pins 30, are formed on the cylindrical surface 12 creating a pattern to support the burning material 20 slightly spaced from the surface 12, with this pattern being substantially open in the curved plane just within the cylindrical surface 12. The material 20 thus, in effect, rests on the ends of the pins 30 so that portions of that material cannot be forced against the openings 18 to block the flow of combustion air through those openings. While the initial intent of the pins 30 was simply to space material from the air supplying openings 18, further analysis shows an additional important function. Because of the pattern defined by the pins is substantially open in the plane closely adjacent to the cylindrical surface there is, in effect, a combustion air chamber created substantially throughout the direct undersurface of the mass of material to be burned, so that the pins increase the effective distribution of air under and through the combustion zone.

In carrying out the invention, the pins 30 are preferably secured directly and in heat transfer relationship to the pipes 11 so that the pins themselves do not reach high, damaging temperatures.

Those familiar with this art will appreciate that the improvement represented by utilizing the pins in the manner described can be economically achieved since individual pins of simple form and shape can be economically welded into place. To give an approximate idea of the scale involved, the pins 30, in a practical embodiment, are on the order of 5 cms in cylindrical length.

I claim as my invention:

1. In a combustor having a plurality of water cooled pipes secured together to define an inner generally cylindrical surface and mounted for rotation about the axis of said surface, said pipes being secured so as to define a plurality of intermediate openings so that said cylindrical surface is gas porous, the improvement comprising, means defining a plurality of projections on said cylindrical surface creating a pattern to support burning material slightly spaced from said surface, said pattern being substantially open in the curved plane just within said cylindrical surface, and said means comprising short pins secured directly and in heat transfer relationship on said pipes of said cylindrical surface.

* * * * *